US007140400B2

(12) United States Patent
Yokochi et al.

(10) Patent No.: US 7,140,400 B2
(45) Date of Patent: Nov. 28, 2006

(54) REINFORCING BAR-BINDING MACHINE

(75) Inventors: Yasushi Yokochi, Tokyo (JP); Ichiro Kusakari, Tokyo (JP); Takahiro Nagaoka, Tokyo (JP); Osamu Itagaki, Tokyo (JP)

(73) Assignee: Max Co., Ltd., Tokyo (JP)

( * ) Notice: Subject to any disclaimer, the term of this patent is extended or adjusted under 35 U.S.C. 154(b) by 0 days.

(21) Appl. No.: 10/530,750

(22) PCT Filed: Sep. 19, 2003

(86) PCT No.: PCT/JP03/12029

§ 371 (c)(1),
(2), (4) Date: Apr. 8, 2005

(87) PCT Pub. No.: WO2004/037648

PCT Pub. Date: May 6, 2004

(65) Prior Publication Data

US 2006/0011254 A1 Jan. 19, 2006

(30) Foreign Application Priority Data

Oct. 28, 2002 (JP) ..... 2002-312185

(51) Int. Cl.
*B21F 15/04* (2006.01)

(52) U.S. Cl. ..... 140/119; 140/57

(58) Field of Classification Search ..... 140/119, 140/57

See application file for complete search history.

(56) References Cited

U.S. PATENT DOCUMENTS

| | | | | |
|---|---|---|---|---|
| 4,362,192 | A * | 12/1982 | Furlong et al. | 140/93.6 |
| 5,431,196 | A * | 7/1995 | Forrester et al. | 140/93.6 |
| 5,947,166 | A * | 9/1999 | Doyle et al. | 140/119 |
| 6,615,879 | B1 | 9/2003 | Kurmis | |

FOREIGN PATENT DOCUMENTS

| | | |
|---|---|---|
| JP | A-06-48411 | 2/1994 |
| JP | A-08-34406 | 2/1996 |
| JP | A-09-278279 | 10/1997 |
| JP | A-2002-255108 | 9/2002 |

* cited by examiner

*Primary Examiner*—Lowell A. Larson
(74) *Attorney, Agent, or Firm*—Morgan, Lewis & Bockius LLP

(57) ABSTRACT

A reverse rotational number of a binding wire feed mechanism is set such that a binding wire is completely pulled back regardless of a boldness or flexibility of the binding wire, a diameter of a reinforcing bar or the like. A driven gear 14 having a V groove of the binding wire feed mechanism is brought into elastic contact with a main drive gear 13 having a V groove by a spring and the binding wire is fed by pinching the binding wire by the main drive gear 13 having the V groove and the driven gear 14 having the V groove. After feeding out the binding wire to form a loop around the reinforcing bar and clamping a front end of the binding wire by a twist mechanism, the binding wire feed mechanism is rotated reversely and the binding wire is pulled back to be wound around the reinforcing bar. After stopping the binding wire, the main drive gear 13 having the V groove and the driven gear 14 having the V groove are slipped relative to the binding wire to rotate idly and continue to rotate reversely until a predetermined rotational number.

11 Claims, 9 Drawing Sheets

REINFORCING BAR-BINDING MACHINE

TECHNICAL FIELD

The present invention relates to a reinforcing bar binding machine, particularly relates to a reinforcing bar binding machine constituted to adjust a length of a binding wire by pulling back the binding wire after winding the binding wire around a reinforcing bar.

BACKGROUND ART

There is known a reinforcing bar binding machine having a binding wire feed-mechanism for feeding out a binding wire and hanging the binding wire around a reinforcing bar and a binding wire twist mechanism for twisting the binding wire wound around the reinforcing bar to bind for carrying out binding operation of 1 cycle by successively executing binding ire binding operation and binding wire twisting operation by trigger operation. Further, as disclosed in, for example, JP-A-08-034406 (claim 2, paragraph No. 0022, paragraph No. 0055), there is proposed a reinforcing bar binding machine for pulling back a binding wire after binding wire feed operation, bringing a loop of the binding wire into close contact with a reinforcing bar to start twisting operation. According to the reinforcing bar binding machine, by pulling back the binding wire, a line length thereof is adjusted in accordance with a diameter of the reinforcing bar to thereby promote finishing and also save to reduce an amount of consuming the binding wire.

In the case of constituting the reinforcing bar binding machine such that the binding wire is pulled back after the binding wire feeding operation and the twisting operation is started in a state of bringing the binding wire into close contact with the reinforcing bar, setting of a pull back tension poses a problem. When a feeding force of the binding line feed mechanism is weak, time is taken in pulling back the binding wire or the binding wire cannot be pulled back. Further, when the feeding force is conversely excessively large, there is a concern of cutting the binding line.

As a means for preventing such a drawback from being brought about, it is conceivable to provide electric control means for setting a motor torque to a degree of being sufficient for pulling back the binding wire and stopping a motor by detecting an increase in a drive current by a rapid increase in a pull back resistance in finishing to pull back the binding wire. However, a flexibility of the binding wire significantly differs by a kind of the binding wire or an environmental condition of an outside air temperature or the like and a width of varying the pull back resistance is wide and therefore, a width of changing the current is not constant, a peak value of the current in stopping the binding wire is significantly varied also by a remaining capacity of a power source battery and therefore, it is difficult to control to stop the motor stably without being influenced by these factors. Further, when there is constructed a constitution of setting a threshold value of the current of stopping the motor at each time for pertinently pulling back the binding wire, the operation becomes complicated and practical performance is deteriorated. Further, there also poses a problem that cost is increased by providing a control circuit including a current detecting circuit or the like.

DISCLOSURE OF THE INVENTION

Hence, there poses a technical problem to be resolved in order to stably pull back a binding wire regardless of a kind of the binding wire, and an external condition, a voltage of a battery or the like and it is an object of the invention to resolve the above-described problem.

The invention is proposed to achieve the above-described object. There is provided a reinforcing bar binding machine comprising a binding wire feed mechanism for feeding out a binding wire to wind around a reinforcing bar, a binding wire grasp mechanism of grasping and twisting the winding wire wound around the reinforcing bar, a binding wire pull back function of pulling back a loop of the binding wire wound around the reinforcing bar to be brought into close contact with the reinforcing bar and thereafter twisting the binding wire, control means for reversely rotating a drive system of the binding wire feed mechanism by a constant number in pulling back the binding wire, and means for permitting to slip the drive system for restricting a pull back tension exerted to the binding wire to be equal to or smaller than a limit value of cutting the binding wire.

Further, there is provided the reinforcing bar binding machine constituting the binding wire feed mechanism by bringing a driven sheave into elastic contact with a main drive sheave and constituted such that when a pull back tension exerted to the binding wire pinched between the pair of sheaves exceeds a certain value, the sheaves are idly rotated to restrict the pull back tension exerted to the binding wire.

Further, there is provided the reinforcing bar binding machine constituting the binding wire feed mechanism by bringing the driven sheave into elastic contact with the main drive sheave, interposing a torque limiter of a friction clutch or a ball clutch to a drive system of the binding wire feed mechanism and constituted such that when a pull back tension exerted to the binding wire pinched between the pair of sheaves exceeds a certain value, the main drive sheave and the driven sheave are stopped to restrict the pull back tension exerted to the binding wire.

Figure 1:
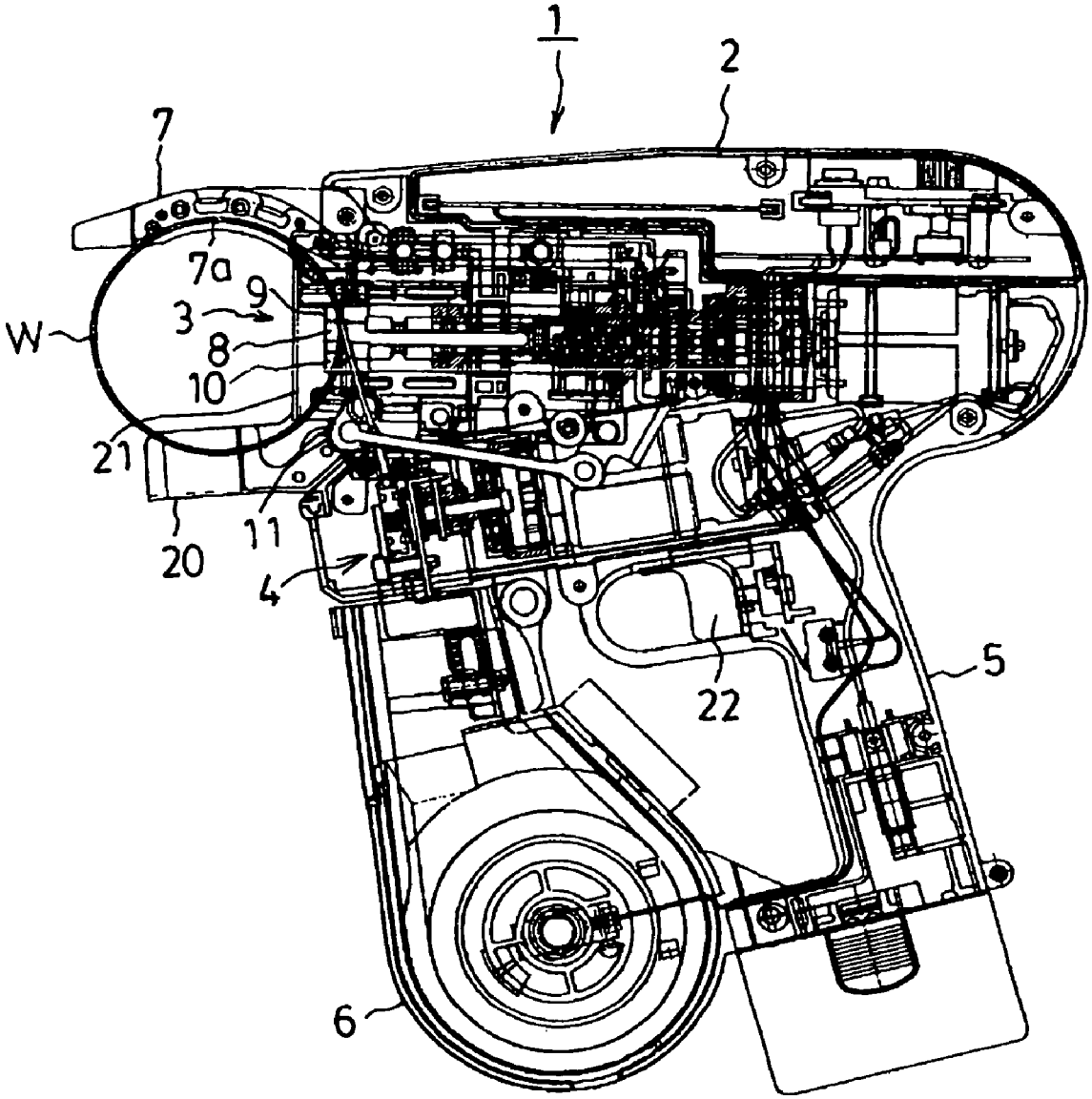
FIG. 1 is a side sectional view of a reinforcing bar binding machine.

Further, in notations in the drawings, numeral 1 designates a reinforcing bar binding machine, numeral 3 designates a binding wire clamp mechanism, numeral 4 designates a binding wire feed mechanism, numeral 6 designates a magazine, numeral 7 designates a nose, numeral 8 designates a center clamp plate, numeral 9 designates a right clamp plate, numeral 10 designates a left clamp plate, numeral 11 designates a cutter devise, numeral 13 designates a main drive gear having a V groove, numeral 14 designates a driven gear having a V groove, numeral 15 designates s feed motor, numeral 16 designates a reduction gear mechanism, numeral 17 designates a lever, numeral 18 designates a compression coil spring, numeral 19 designates a binding wire guide, numeral 23 designates a gear for feeding, numeral 24 designates a torque limiter, notation W designates a binding wire, notation S designates s reinforcing bar.

BEST MODE FOR CARRYING OUT THE INVENTION

Although an embodiment of the invention will be described in details in reference to the drawings as follows, for convenience of explanation, first, an outline of a total constitution of a reinforcing bar binding machine will be explained. FIG. 1 shows a reinforcing bar binding machine 1. A binding wire clamp mechanism 3 and A binding wire feed mechanism 4 are included in a casing 2. A binding wire reel (not illustrated) is charged into the magazine 6 arranged on a front side of a grip 5. A binding wire W wound on the binding wire reel is fed out to an upper side by the binding wire feed mechanism 4, forms a loop along a guide groove 7*a* at an inner periphery of a nose 7 and is fed into the binding wire clamp mechanism 3. The binding wire clamp mechanism 3 is constituted by a center clamp plate 8 and a movable clamp plates 9, 10 on left and right sides thereof. A front end of the binding wire W is brought to between the right clamp plate 9 (depth side of paper face of FIG. 1) and the center clamp plate 8 to be clamped. Successively, the binding wire feed mechanism 4 is driven to reversely rotate to pull back the binding wire W to bring about a state of winding the binding wire W around the reinforcing bar and the left clamp plate 10 is closed. A rear end of the binding wire loop is clamped by the left clamp plate 10 and the center clamp plate 8. Further, the cutter devise 11 cuts the rear end of the binding wire loop. The binding wire clamp mechanism 3 is rotated in a state of clamping both ends of the binding wire loop. By twisting together the both ends of the binding wire loop, the reinforcing bar is wound.

Figure 2:
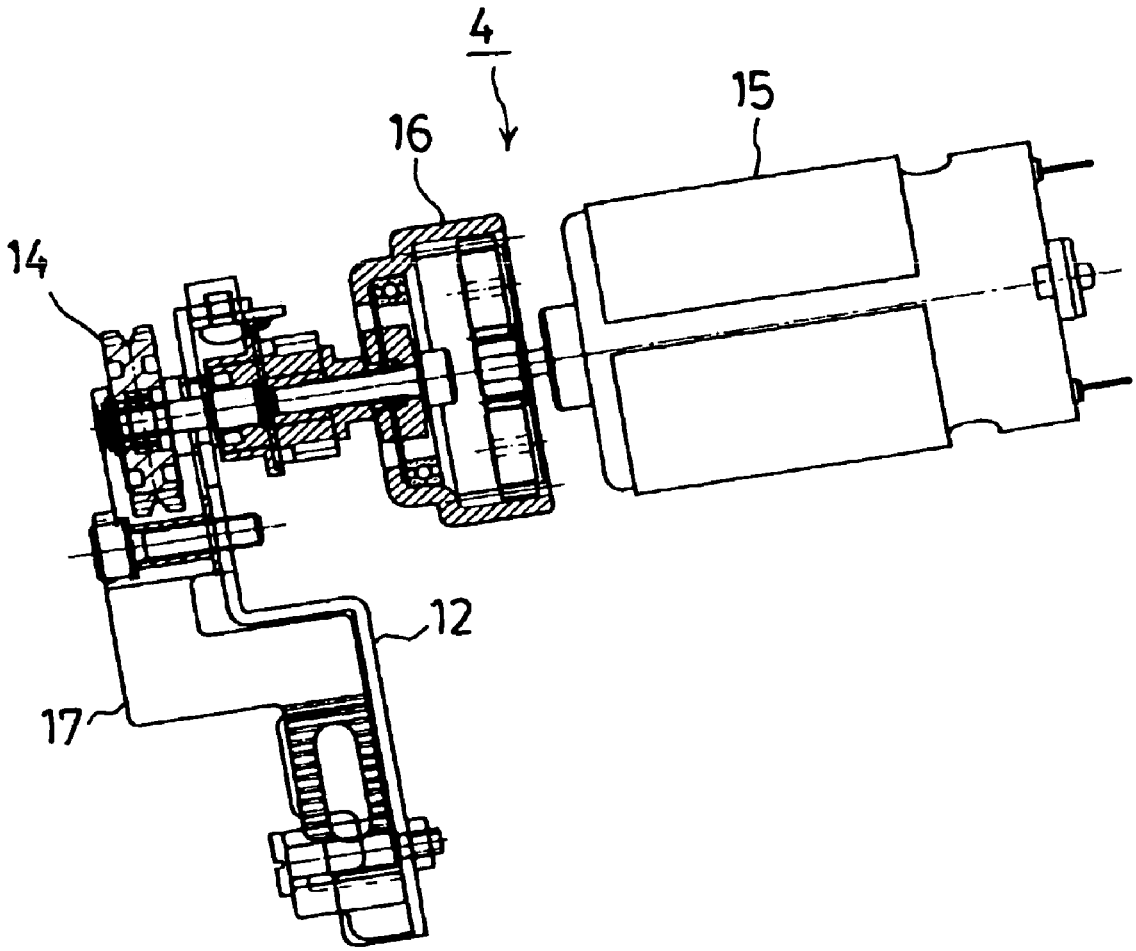
FIG. 2 is a side sectional view of a binding wire feed mechanism.
Figure 3:
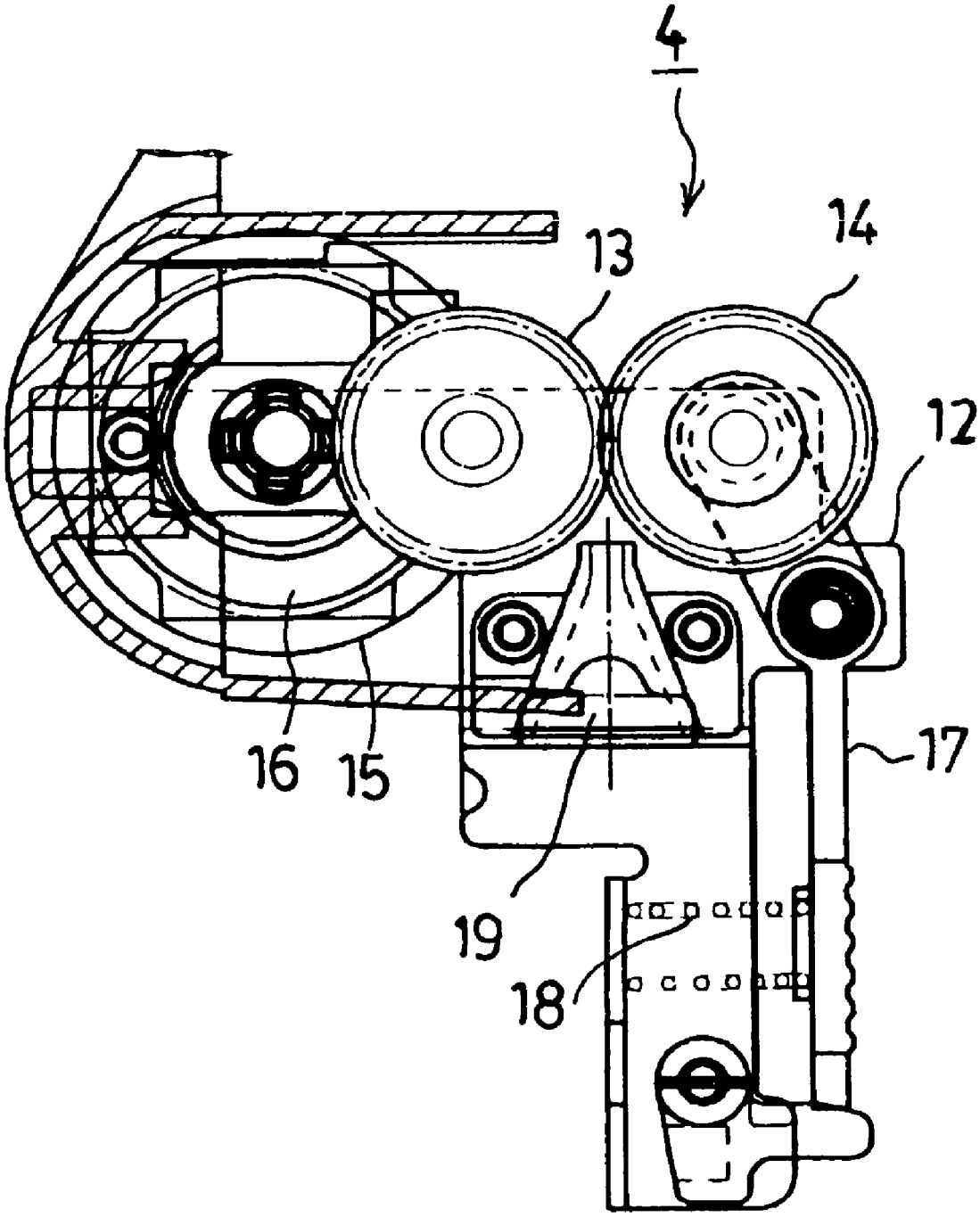
FIG. 3 is a front view of the binding wire feed mechanism.
Figure 4:
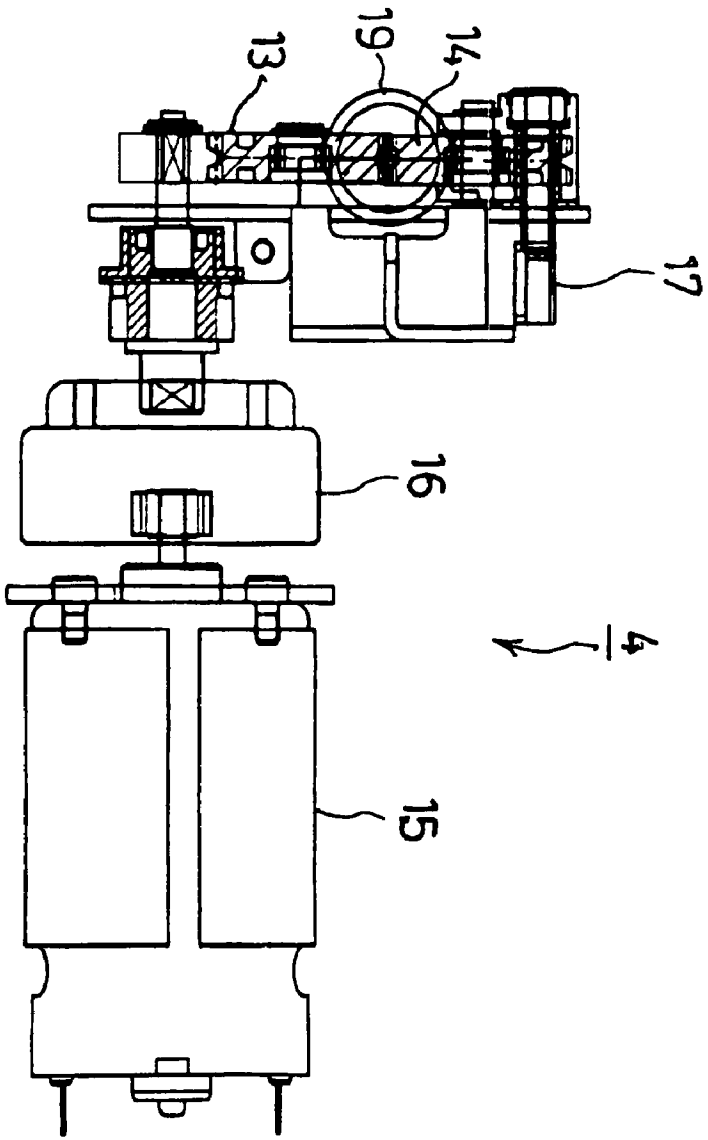
FIG. 4 is a bottom view of the binding wire feed mechanism.

FIG. 2 through FIG. 4 shows the binding wire feed mechanism 4. A main drive gear 13 having a V groove and a driven gear 14 having a V groove are arranged on a base plate 12. The two pieces of the gears 13, 14 having the V grooves are brought in mesh with each other. A gear of the reduction gear mechanism 16 connected to the feed motor 15 is brought in mesh with the main drive gear 13 having the V groove. As shown by FIG. 3, the driven gear 14 having the V groove which is not directly brought in mesh with the feed motor 15 is attached to the lever 17 and is brought into elastic contact with the main drive gear 13 having the V groove by a spring force of the compression coil spring 18 attached to the lever 17, and a contact pressure between the main drive gear 13 having the V groove and the driven gear 14 having the V groove is determined by the spring force of the compression coil spring 18.

When a lower end portion of the lever 17 is pressed to a center side (left side of FIG. 3), the driven gear 14 having the V groove attached to an upper portion thereof is moved laterally to leave from the main drive gear 13 having the V groove on the motor side, and the binding wire can be passed between the main drive gear 13 having the V groove and the driven gear 14 having the V groove. The binding wire guide 19 having a funnel shape is provided on a lower side of a middle of the two pieces of the gears 13, 14 having the V grooves, and the binding wire is set to between the main drive gear 13 having the V groove and the driven gear 134 having the V groove by passing the binding wire through the binding wire guide 19 from the lower side.

As described above, in 1 cycle operation of the reinforcing bar binding machine 1, respective steps of feeding the biding wire, clamping the front end of the binding wire loop, pulling back the binding wire, clamping the rear end of the binding wire loop, cutting the binding wire and twisting the binding wire are successively executed by a control of a control portion of a microprocessor or the like. The aspect of the invention resides numbers of reversely rotating the feed motor 15 and the main drive gear 13 having the V groove of the binding wire feed mechanism 4, in the step of pulling back the binding wire, are set to values sufficient for completely pulling back the binding wire, in any conditions. Further, a principal point thereof resides in that the control pressure of the main drive gear 13 having the V groove and the driven gear 14 having the V groove is set in consideration of a strength of the binding wire. When two pieces of the gears 13, 14 having the V grooves are rotated in a state of forcibly stopping the binding wire, the binding wire is prevented from being cut by slipping the gears 13, 14 having the V grooves and the biding wire.

Figure 5:
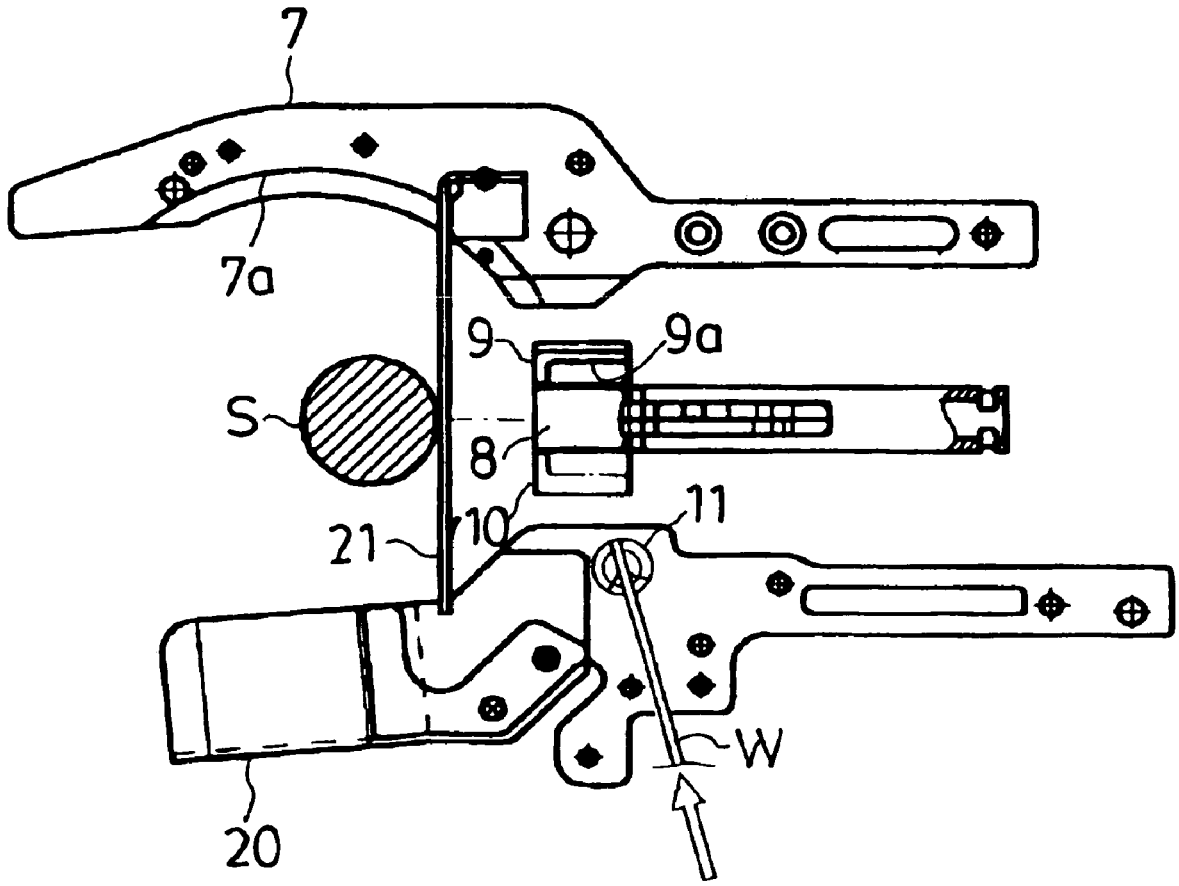
FIG. 5 shows a step of operating the reinforcing bar binding machine and is a side view showing an initial state.
Figure 6:
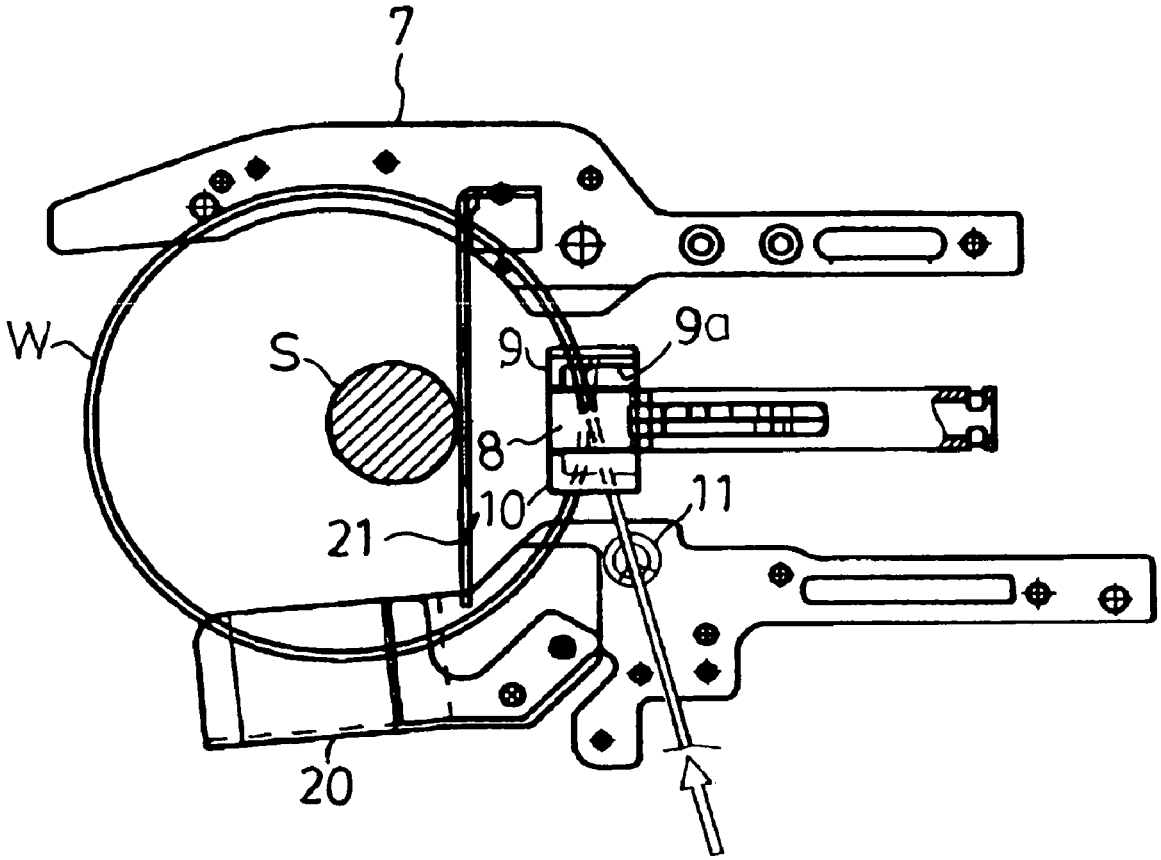
FIG. 6 shows a step of operating the reinforcing bar binding machine and is a side view showing a step of forming a loop of the binding wire.

FIG. 5 shows an initial state of the reinforcing bar binding machine 1, and a front end of the binding wire W is disposed at a position the same as that of a front end of the cutter devise 11. When a guide plate 21 hung between the nose 7 and a lower side guide arm 20 of the reinforcing bar binding machine is pressed to the reinforcing bar S and a trigger lever 22 shown in FIG. 1 is pulled, the binding wire feed mechanism 4 is started to feed out the binding wire W to the upper side. As shown by FIG. 6, the binding wire W is formed in a loop shape along the nose 7, the front end is brought to between the center clamp plate 8 and the guide clamp plate 9 (depth side of paper face) of the binding wire clamp mechanism 3 and impinges on a stopper portion 9*a* provided at an upper end of the right clamp plate 9 to stop. The right clamp plate 9 is closed by a cam mechanism and the front end of the binding wire is clamped by the center clamp plate 8 and the right clamp plate 9.

Figure 7:
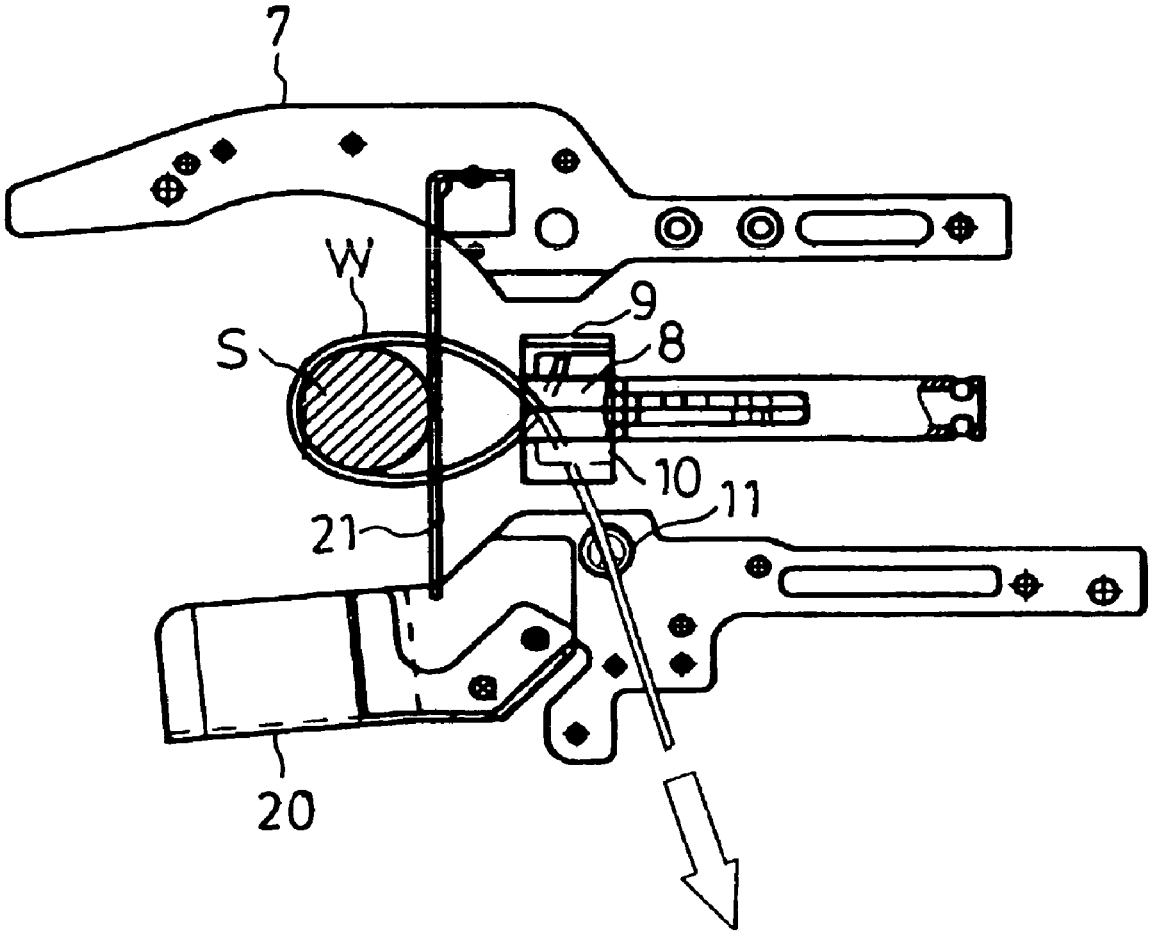
FIG. 7 shows a step of operating the reinforcing bar binding machine and is a side view showing a step of pulling back the binding wire.

Successively, the binding wire W is pulled back by reversely driving to rotate the main drive gear 13 having the V groove and the driven gear 14 having the V groove of the binding wire feed mechanism 4, the feed motor 15 is driven to rotate reversely up to a previously set rotational number by the control portion and the binding wire W is wound around the reinforcing bar S as shown by FIG. 7. Further, after sufficiently pulling back the binging wire W to stop, the gears 13, 14 having the V grooves are reversely rotated until reaching a predetermined rotational number, and the main drive gear 13 having the V groove and the driven gear 14 having the V groove are reversely rotated in an idly rotated state by slipping while pinching the binding wire W until the feed motor 15 is stopped. That is, even when there is a difference in a diameter of the reinforcing bar, a difference of an amount of pulling back the binding wire W can be absorbed by idly rotating the gears 13, 14 having the V grooves. In this way, by setting the reverse rotational number of the gears 13, 14 having the V grooves constant, the binding wire W can be brought into close contact with the reinforcing bar S regardless of a boldness or a number of pieces of the reinforcing bars, a kind of the binding wire, and an external condition of an outside air temperature or the like, or a voltage of a battery.

Figure 8:
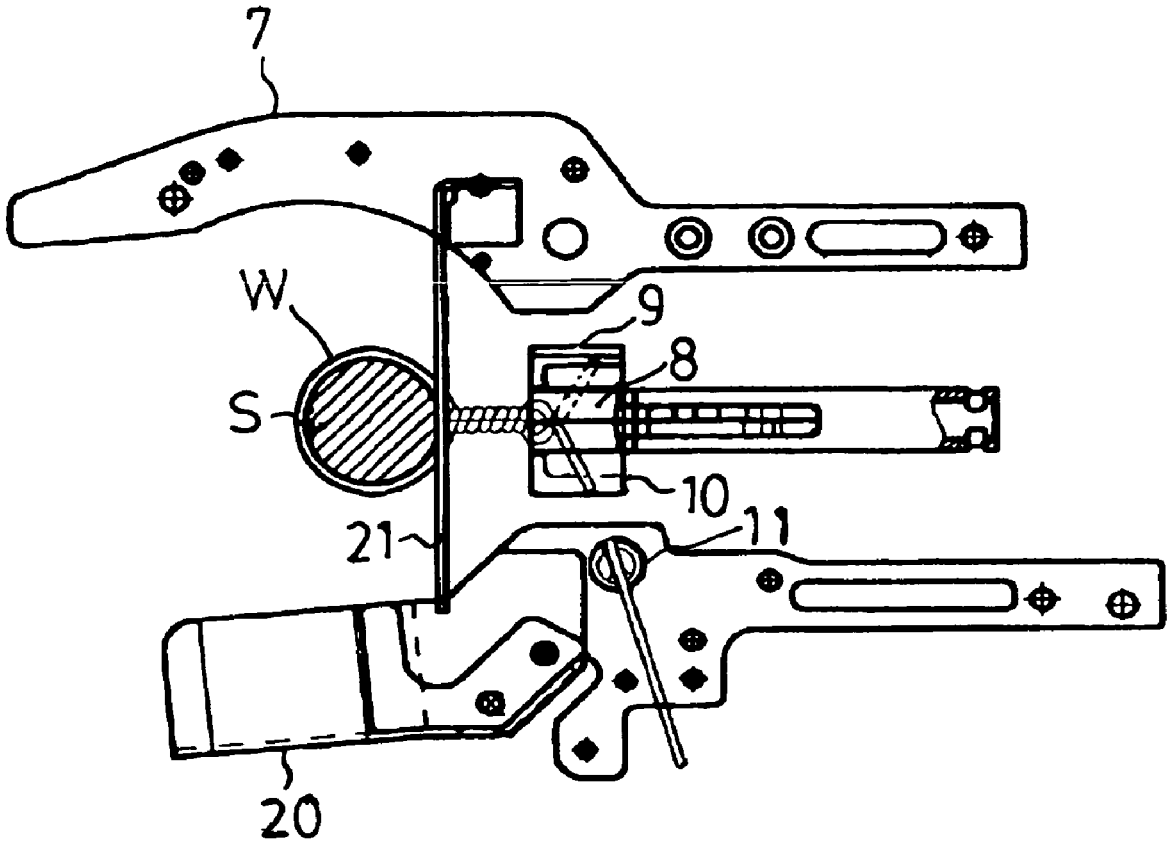
FIG. 8 shows a step of operating the reinforcing bar binding machine and is a side view showing a step of twisting the binding wire.

Successively, after cutting the binding wire W by driving to rotate an outer side ring portion of the cutter devise 11, the left clamp plate 10 is closed by the cam mechanism and the rear end of the binding wire is clamped by the center clamp plate 8 and the left clamp plate 10, a total of the biding wire clamp mechanism 3 is driven to rotate and the reinforcing bar S is bound by twisting an end portion of the loop of the binding wire W as shown by FIG. 8. Further, after finishing to bind the wire, the clamped end portion of the binding wire W is released to return to the initial state of FIG. 5. Further, with regard to the control of the reverse rotational number of the main drive gear 13 having the V groove, various detecting means of a pulse detecting circuit of detecting the rotational number of the feed motor 15, a rotational number sensor of directly detecting the rotational number of the main drive gear 13 having the V groove and the like are naturally applicable.

Figure 9:
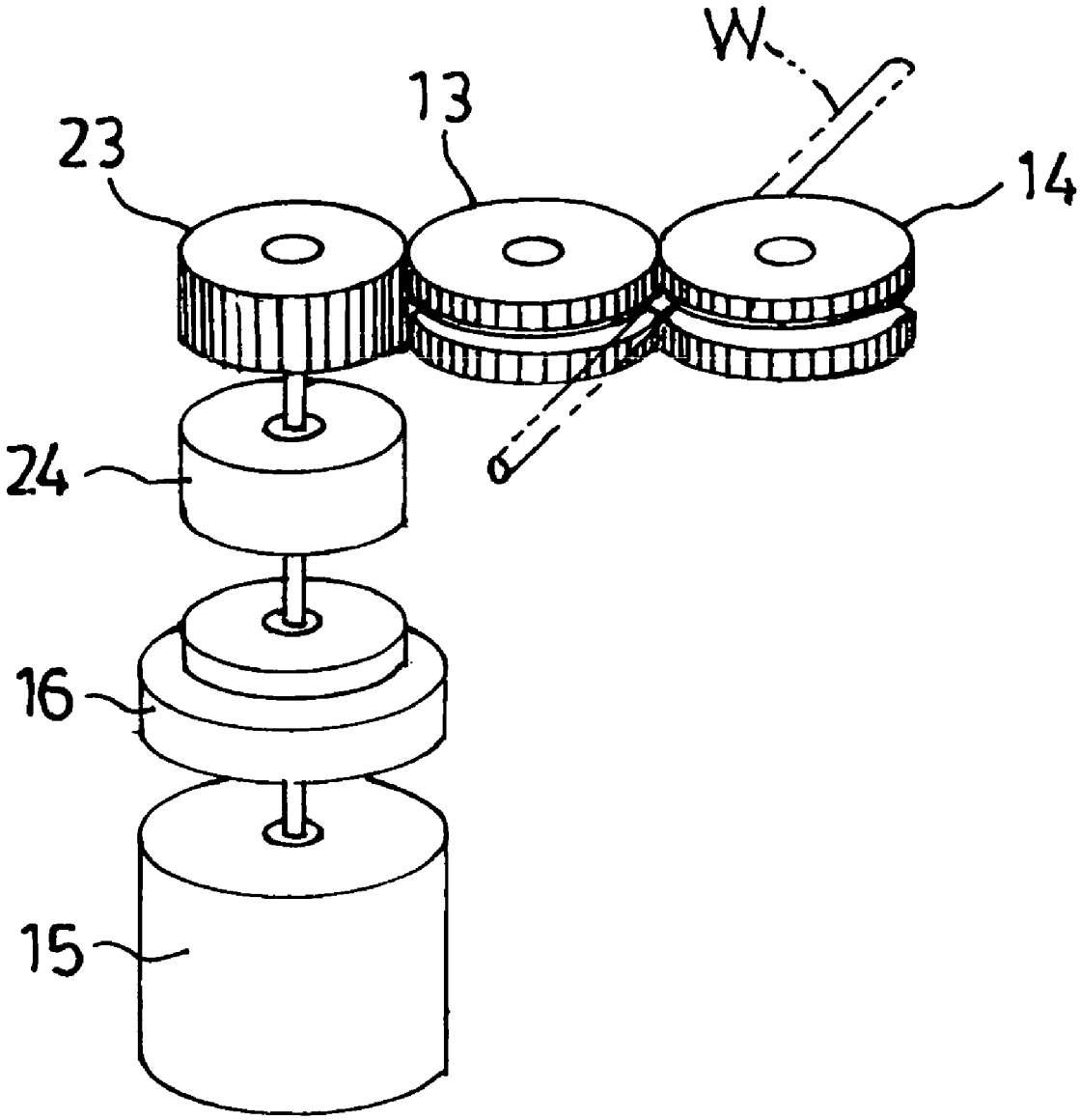
FIG. 9 is an explanatory view of a constitution showing other embodiment of the binding wire feed mechanism.

Further, in place of the constitution of setting the contact pressure of the main drive gear 13 having the V groove and the driven gear 14 having the V groove to permit to slip the binding wire W, as shown by FIG. 9, there may be constructed a constitution in which a torque limiter 24 of a friction clutch or a ball clutch or the like is interposed between an output shaft of the reduction gear mechanism 16 and the gear 13 for feeding, after completely pulling back the binding wire W, the main drive gear 13 having the V groove and the driven gear 14 having the V groove are stopped by friction relative to the binding wire W, and only the feed motor 15 and the reduction gear mechanism 16 are rotated up to the predetermined reverse rotational number.

Further, the invention is not limited to the above-described embodiment but can variously modified further in the technical range of the invention and the invention can naturally cover the modifications.

INDUSTRIAL APPLICABILITY

As has been explained above, according to the reinforcing bar binding machine of the invention, the binding wire feed mechanism is driven to rotate reversely by the constant rotational number in the step of pulling back the binding wire, when pulling back is finished before finishing the pulling back step, the drive system is reversely rotated by slipping relative to the binding wire and therefore, the binding wire can completely be pulled back regardless of the boldness or the number of pieces of the reinforcing bars, the kind of the binding wire, the external condition, the voltage of the battery or the like and there is not a concern of cutting the binding wire, which archives an effect in stabilizing a binding function.

The invention claimed is:

1. A reinforcing bar binding machine comprising:

a binding wire feed mechanism for feeding out a binding wire so as to wind around a reinforcing bar;

a binding wire grasp mechanism for grasping and twisting the winding wire wound around the reinforcing bar;

a binding wire pull back mechanism for pulling back a loop of the binding wire wound around the reinforcing bar to be brought into close contact with the reinforcing bar and thereafter twisting the binding wire;

control means for reversely rotating a drive system of the binding wire feed mechanism by a predetermined rotational number in pulling back the binding wire;

detecting means for detecting the reverse rotational number; and means for permitting to slip the drive system for restricting a pull back tension exerted to the binding wire to be equal to or smaller than a limit value of cutting the binding wire.

2. The reinforcing bar binding machine according to claim 1, wherein the binding wire feed mechanism comprises:

a main drive sheave; and a driven sheave brought into elastic contact with the main drive sheave, and when a feed back tension exerted to the binding wire pinched between the pair of sheaves exceeds a certain value, the sheaves are idly rotated and the pull back tension exerted to the binding wire is restricted.

3. The reinforcing bar feeding machine according to claim 1, wherein the binding wire feed mechanism comprises:

a main drive sheave; and a driven sheave brought into elastic contact with the main drive sheave, the drive system of the binding wire feed mechanism includes a torque limiter, and when a pull back tension exerted to the binding wire pinched between the pair of grooves wheels exceeds a certain value, the main drive sheave and the driven sheave are stopped so as to restrict the pull back tension exerted to the binding wire.

4. The reinforcing bar binding machine according to claim 3, wherein the torque limiter is a friction clutch or a ball clutch.

5. The reinforcing bar binding machine according to claim 1, wherein the detecting means comprises a pulse detecting circuit that detects the rotational number of a feed motor.

6. The reinforcing bar binding machine according to claim 1, wherein the binding wire feed mechanism comprises a main drive sheave, and a driven sheave brought into elastic contact with the main drive sheave, and the detecting means comprises a rotational number sensor that detects the rotational number of the main drive sheave.

7. A reinforcing bar binding machine comprising:

a drive sheave;

a driven sheave brought into elastic contact with the drive sheave;

a motor that normally and reversely drives the drive sheave;

a lever to which the driven sheave is attached;

a spring attached to the lever, wherein the driven sheave is brought into elastic contact with the drive sheave by a spring force of the spring; and a pulse detecting circuit that detects the rotational number of the motor, wherein the motor normally drives the drive sheave so as to feed a binding wire, and reversely drives the drive sheave so as to pull back the binding wire until reaching a predetermined rotational number.

8. A reinforcing bar binding machine comprising:

a drive sheave;

a driven sheave brought into elastic contact with the drive sheave;

a lever to which the driven sheave is attached;

a spring attached to the lever, wherein the driven sheave is brought into elastic contact with the drive sheave by a spring force of the spring; and a rotational number sensor that detects the rotational number of the drive sheave, wherein the motor normally drives the drive sheave so as to feed a binding wire, and reversely drives the drive sheave so as to pull back the binding wire until reaching a predetermined rotational number.

9. A reinforcing bar binding machine comprising:

a drive sheave;

a driven sheave in mesh with the drive sheave;

a motor that normally and reversely drives the drive sheave;

a torque limiter disposed between the motor and the drive sheave; and a pulse detecting circuit that detects the rotational number of the motor, wherein the motor normally drives the drive sheave so as to feed a binding wire, and reversely drives the drive sheave so as to pull back the binding wire until reaching a predetermined rotational number.

10. The reinforcing bar binding machine according to claim 9, wherein the torque limiter comprises one of a friction clutch and a ball clutch.

11. A reinforcing bar binding machine comprising:

a drive sheave;

a driven sheave in mesh with the drive sheave;

a motor that normally and reversely drives the drive sheave;

a torque limiter disposed between the motor and the drive sheave; and a rotational member sensor that detects the rotational number of the drive sheave, wherein the motor normally drives the drive sheave so as to feed a binding wire, and reversely drives the drive sheave so as to pull back the binding wire until reaching a predetermined rotational number.

* * * * *